US009139996B2

(12) United States Patent
Cohen

(10) Patent No.: US 9,139,996 B2
(45) **Date of Patent: *Sep. 22, 2015**

(54) REMOVABLE LOCKING FLOOR SINK DRAIN SCREEN FOR ENLARGED OPENING

(71) Applicant: TNT Products, LLC, Chatsworth, CA (US)

(72) Inventor: Todd R. Cohen, Chatsworth, CA (US)

(73) Assignee: TNT PRODUCTS, LLC, Chatsworth, CA (US)

( * ) Notice: Subject to any disclaimer, the term of this patent is extended or adjusted under 35 U.S.C. 154(b) by 32 days.

This patent is subject to a terminal disclaimer.

(21) Appl. No.: 13/718,714

(22) Filed: Dec. 18, 2012

(65) Prior Publication Data

US 2014/0166560 A1 Jun. 19, 2014

(51) Int. Cl.

| | |
|---|---|
| ***E03F 5/06*** | (2006.01) |
| ***E03F 5/04*** | (2006.01) |
| *E03C 1/26* | (2006.01) |

(52) U.S. Cl.

CPC ..... *E03F 5/0407* (2013.01); *E03F 5/041* (2013.01); *E03F 5/06* (2013.01); *E03C 1/26* (2013.01); *E03F 2005/063* (2013.01); *E03F 2005/065* (2013.01); *E03F 2005/066* (2013.01)

(58) Field of Classification Search

CPC ..... E03F 5/04; E03F 5/0407; E03F 5/0408; E03F 5/041; E03F 5/06; E03F 2005/063; E03F 2005/065

USPC ..... 210/163, 164, 232, 460, 463, 474; 4/292, 679; 52/302.1; 285/346

See application file for complete search history.

(56) References Cited

U.S. PATENT DOCUMENTS

| | | | | |
|---|---|---|---|---|
| 5,297,817 | A * | 3/1994 | Hodges | 285/346 |
| 5,695,222 | A * | 12/1997 | Hodges | 285/346 |
| 6,165,357 | A * | 12/2000 | Cormier | 210/163 |
| 6,330,724 | B1 * | 12/2001 | Belle | 4/288 |
| 7,600,644 | B2 * | 10/2009 | McCallum | 210/163 |
| 7,784,242 | B2 * | 8/2010 | Warnecke | 210/163 |
| 7,964,095 | B1 * | 6/2011 | Graybeal | 210/164 |
| 8,496,811 | B2 * | 7/2013 | Cohen | 210/163 |
| 8,628,657 | B1 * | 1/2014 | Robillard et al. | 210/163 |
| 2008/0295236 | A1 * | 12/2008 | Eichler et al. | 4/292 |

* cited by examiner

*Primary Examiner* — Christopher Upton

(74) *Attorney, Agent, or Firm* — Gregory Wood; Feldman Gale, P.A.

(57) ABSTRACT

An improved locking floor sink drain screen for an enlarged drain is provided. The locking floor sink drain positively precludes passage of large objects, while permitting free passage of fluid and which can quickly and easily be removed for cleaning. Vertical separators provide spaces through which water can flow from the enlarged drain opening into a standard drain pipe. In some embodiments, a special, tamperproof locking key may be used to prevent unauthorized disassembly of the installed floor drain screen.

6 Claims, 4 Drawing Sheets

REMOVABLE LOCKING FLOOR SINK DRAIN SCREEN FOR ENLARGED OPENING

FIELD OF INVENTION

This invention relates to plumbing devices and is particularly directed to improved means for blocking floor sink drain openings to prevent passage of large objects, while allowing free flow of fluid therethrough.

As is well known, food preparation kitchens are usually provided with a floor sink having a drain opening which connects to a grease trap or sewer to allow disposal of indirect waste water and the like. Unfortunately, rags, napkins, silverware and other large objects are often washed into the floor sink along with the floor washing water and these objects often get carried into the drain and cause blockage, flooding and other problems. Moreover, the loss of napkins, silverware and the like add significant expense to the operation of the restaurant. Unfortunately, most floor sinks have open drains which are subject to the problems noted above. Some prior art drain grates or screens have been provided which are permanently installed in the drain opening. However, these often become clogged and simply add to the flooding problem. Thus, none of the prior art sink drain screens have been entirely satisfactory.

SUMMARY OF THE INVENTION

These disadvantages of the prior art are overcome with the present invention and an improved floor sink drain screen is provided which positively precludes passage of large objects, while permitting free passage of fluid and which can quickly and easily be removed for cleaning, when desired. In some embodiments, a special, tamperproof locking key may be used to prevent unauthorized disassembly of the installed floor drain screen.

These advantages of the present invention are preferably attained by providing an improved floor sink drain screen lock having expandable means for engaging the walls of a floor sink drain, yet being readily collapsible for quick and easy removal when desired.

Accordingly, it is an object of the present invention to provide an improved floor sink drain screen locking apparatus.

Another object of the present invention is to provide an improved floor sink drain screen lock which positively precludes passage of large objects.

A further object of the present invention is to provide an improved floor sink drain screen lock which positively precludes passage of large objects while permitting free passage of liquids.

An additional object of the present invention is to provide an improved floor sink drain screen lock which positively precludes passage of large objects while permitting free passage of liquids and which can quickly and easily be removed for cleaning, when desired.

Yet another object of the present invention is to provide improved floor sink drain screen locks having expandable means for sealingly engaging the walls of a floor sink drain, yet being readily collapsible for quick and easy removal when desired.

These and other objects and features of the present invention will be apparent from the following detailed description, taken with reference to the figures of the accompanying drawing.

DETAILED DESCRIPTION OF THE INVENTION

Figure 1:
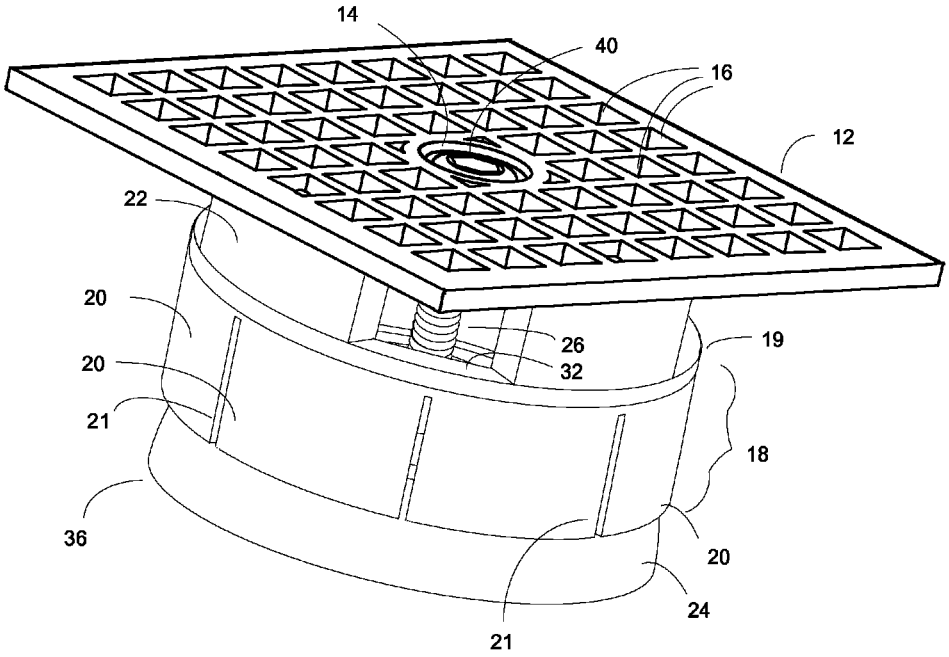
FIG. 1 is an upper isometric view of a removable locking floor sink drain screen for enlarged opening embodying the invention.

FIG. 1 depicts a locking floor sink drain for an enlarged opening, indicated generally at 10. An upper grate 12 formed with a central opening 14 is surrounded by a plurality of additional openings 16 through which water or any other liquid can be drained. A middle section 18 has a non-expandable section 19 with an internal flange 32 that supports a plurality of vertical separators 22. An expandable ring section consists of a number of panels 20 separated by a plurality of slits 21 that permit the panels 20 to be forcefully expanded against the inner surface of a drain pipe (not shown). The vertical separators 22 space the grate 12 from the flange 32 and are themselves spaced apart to permit draining liquid to flow into and through the center cavity of the device and down the drain pipe. Positioners 30 attached to the vertical separators 22 interface with the grate 12 to prevent substantial rotational or sliding movement between the grate 12 and the separators 22. The separators 22 also position and secure the grate 12 above the middle section 18.

A hollow tapered section 24 has an outer diameter 36 that is larger than the inner diameter of middle section 18 and incorporates internal structure to form a threaded hole 28. Threaded hole 28 receives a threaded bolt 26 that extends through the central opening 14 of the grate 12, through the middle section 18, and secures the grate 12 to tapered section 24. When tightened, the threaded bolt 26 pulls the tapered section 24 upward and into the middle section 18, causing the panels 20 of the middle section to expand against the inner diameter of the drain pipe.

Although depicted as a square plate, the metal grate can be circular, rectangular, or of an irregular shape, depending upon the configuration of the installation environment.

Figure 2:
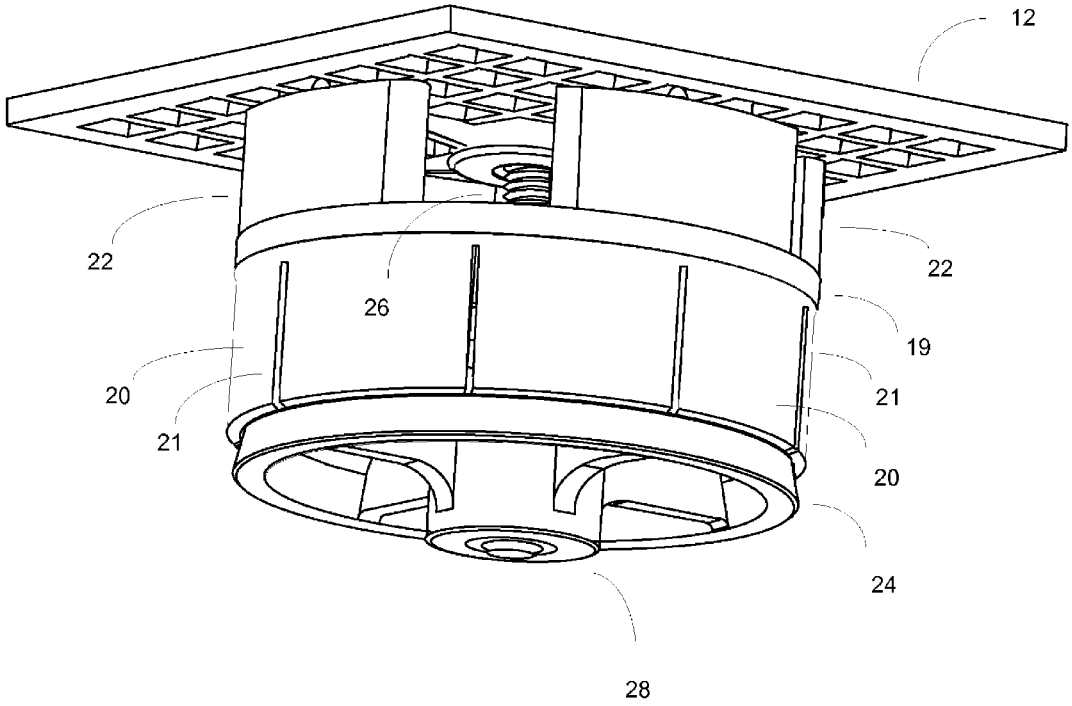
FIG. 2 is a lower isometric view of an embodiment of the invention.

FIG. 2 is a lower isometric view of the drain locking device for an enlarged drain. This view provides some detail of the tapered section 24, and shows exemplary structure through which threaded hole 28 is formed.

Figure 3:
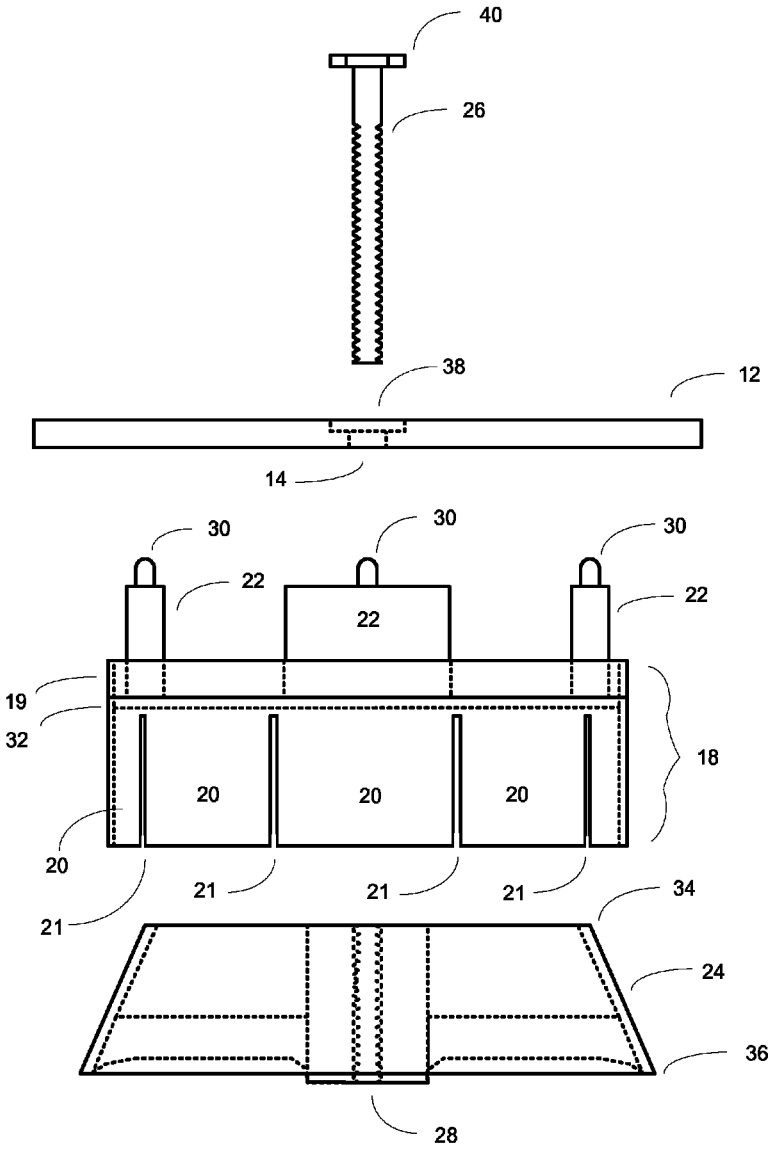
FIG. 3 is an exploded front view of an embodiment of the invention.

FIG. 3 shows an exploded front view of the locking device of this invention. Threaded bolt 26 may have a head 40 which may be a slotted screw, a hexagonal head, a tamperproof head, or any other suitable means know in the art for tightening or loosening bolt 26. In a preferred embodiment, grate 23 may be metallic, such as brass or stainless steel, although any suitable corrosion-resistant material of sufficient strength and flexibility will suffice, and will have an indented portion 38 to receive the head 40 of bolt 26 and position it flush with the upper grate surface. The grate 23 is supported by vertical separators 22, and optionally may be secured by positioners 30 or, in some embodiments, suitable fastening means to hold middle section 18 in a fixed relationship with respect to grate 23. Vertical separators 22 are supported by an internal flange 32 located within upper non-expandable portion 19 of middle section 18. The lower portion of middle section 18 is a plurality of panels 20 being separated by slits 21 whereby the panels 20 may be forced apart and outwardly against the interior surface of a drain pipe (not shown).

A frusto-conical tapered section 24 of the device has a threaded through hole 28 that receives threaded bolt 26. The upper diameter 34 of the tapered section 24 is smaller than the inner diameter of middle section 18, while the lower diameter 36 of the tapered section is larger than the inner diameter of middle section 18. As threaded bolt 26 is tightened, tapered section 24 is drawn up against the expandable section 20 of middle section 18, causing the panels 20 to expand and press against the inner surface of a drain pipe and lock the device into the drain.

Figure 4A:
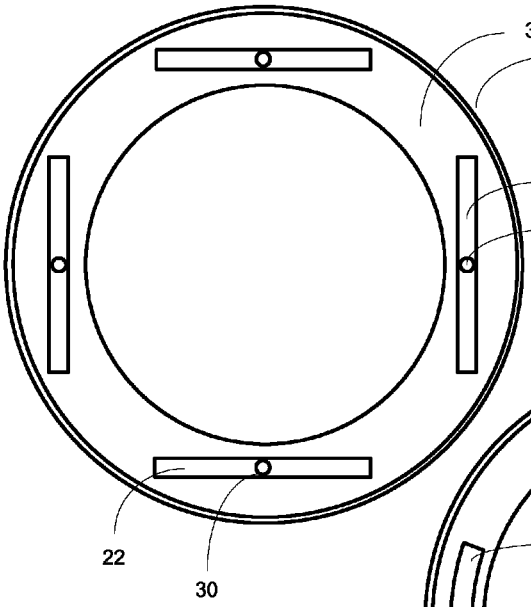
FIG. 4*a* is a plan view of an embodiment of the center section of the locking floor sink drain screen.
Figure 4B:
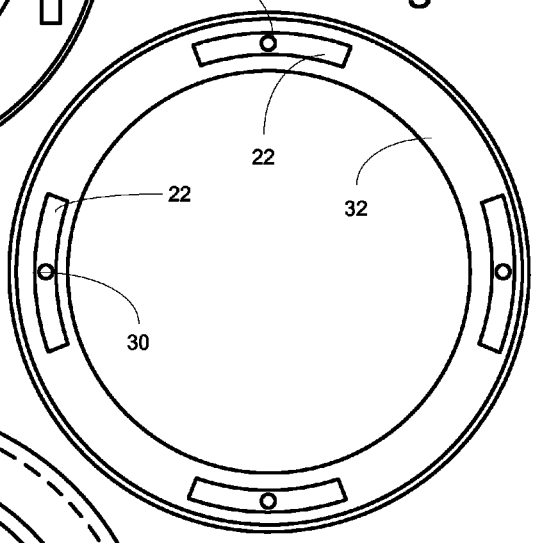
FIG. 4*b* is a plan view of another embodiment of the center section of the locking floor sink drain screen.

FIG. 4*a* is a plan view of the middle section 18 of the device of this invention. As viewed from above in FIG. 4*a*, vertical separators 22 may have a rectangular cross-section and a positioning knob or fastening means 30 to interface with the grate 12. Fastening means 30 may assist in maintaining the physical relationship between grate 12 and middle section 18, and may be positioning knobs, threaded screws, or any other suitable fastening means known in the art. An internal flange 32 supports vertical separators 22 within non-expandable portion 19 of middle section 18. FIG. 4*b* depicts the separators 22 as being curved, and permits flange 32 to have a smaller lip, thus increasing the size of the cavity through which liquid may flow. Although the embodiment depicted in FIGS. 4*a* and 4*b* shows four separators, the choice of configuration of separators 22 as rectangular or of some other shape, and of the number of separators, is not critical to the function of the invention and may be a matter of design choice.

Figure 5:
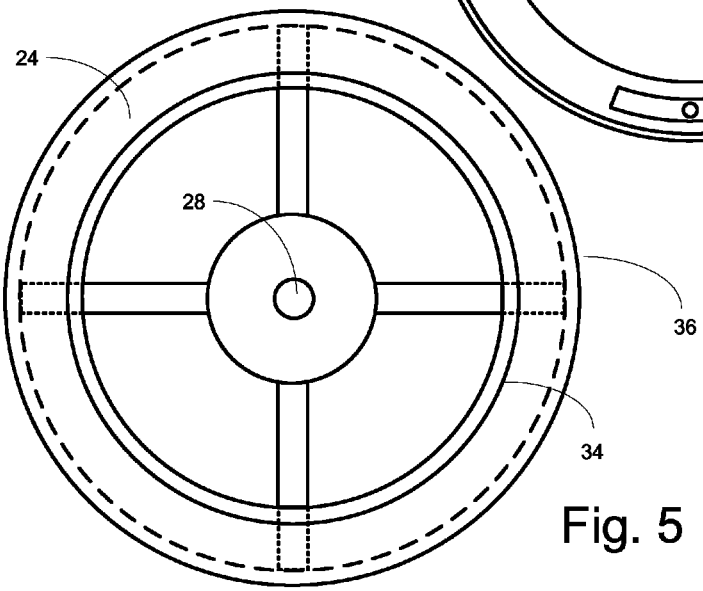
FIG. 5 is a plan view of the lower section of the locking floor sink drain screen.

FIG. 5 is a plan view of the tapered section 24. Threaded through hole 28 receives the threaded bolt 26, while the smaller upper diameter 34 and larger lower diameter 36 form a frusto-conical surface that will cause expandable panels 20 to be forced outwardly when the tapered section 24 is drawn upward as bolt 26 is tightened.

In use, the locking floor sink drain screen 10 is inserted into the mouth of a floor sink drain so that the grate 12 rests on the surface of the area being drained and, preferably, within an indented cavity that will support the grate flush with the surface to be drained. The middle portion 18 and tapered portion 24 of the device are attached to the grate with threaded bolt 26, and extend downwardly to fit within the upper end of a drain pipe. The bolt 26 is then tightened which serves to draw the tapered section 24 toward the middle section 18, which causes the expandable panels 20 to expand laterally to wedge against and frictionally engage the drain pipe opening. This ensures that the device 10 will not be displaced during use. Because the device of this invention is intended for use in drains where the drain pipe is smaller than the mouth of the floor sink drain, liquid can flow through openings 16 in the grate 12 and through spaces between vertical separators 22, and further through the large opening in tapered section 24, where it will be channeled into the drain pipe. However, any large objects will be blocked by the mesh-like structure of the grate 12. If the openings 16 become clogged over time, bolt 26 can be loosened, allowing tapered section 24 to be forced downward, releasing friction on expandable panels 20 and allowing the floor sink drain 10 to be removed for cleaning. Subsequently, the drain screen lock 10 can be reinserted in the floor sink drain opening in the manner described above for further use.

Bolt 26 may be tamperproof such that special tools are required for installation or removal of the device from a drain. Because the drain pipe will be some distance below the grate and floor openings, the middle section 18 and tapered section 24 may be of any length, and will be sized to fit within a drain of corresponding size. Vertical separators may be of any height but, preferably, will be no longer than about one inch (2.54 cm).

Numerous variations and modifications can be made without departing from the spirit of the present invention. Therefore, it should be clearly understood that the forms of the present invention described above and shown in the accompanying drawing are illustrative only and are not intended to limit the scope of the present invention.

What is claim is:

1. In a floor sink drain in which the floor opening is larger than the drain pipe through which liquid is to be drained, a floor sink drain screen and lock comprising:

a first section, said first section comprising a grate formed with a central opening surrounded by a plurality of additional openings, a second section, said second section comprising a central opening therethrough, a plurality of expandable panels extending circumferentially about said second section, and a plurality of vertical separators separating said grate from said plurality of expandable panels;

a third section, said third section comprising a hollow section having a tapered outer surface and a central internally threaded opening, said tapered outer surface forming a frusto conical configuration in which the smaller diameter end is closer to said grate than said larger diameter end, a bolt extending through said central opening of said grate and threadedly engaging the centrally internally threaded opening of said third section.

2. The floor sink drain screen of claim 1 wherein said second section further comprises an internal flange extending at least partially around the circumference of said second section and that supports said plurality of vertical separators.

3. The floor sink drain screen of claim 1 wherein at least two of said plurality of vertical separators further comprises one or more positioners interfacing with said grate whereby, when said floor sink drain screen is assembled, said positioners prevent substantial movement between said vertical separators and said grate.

4. The floor sink drain screen of claim 1 wherein said one or more positioners further comprise fasteners to securely attach said vertical separators to said grate.

5. The floor sink drain screen of claim 1 wherein said vertical separators extend above said second section by no more than about one inch.

6. A floor sink drain screen lock comprising a grate formed with a central opening surrounded by a plurality of additional openings, an expandable section comprising expandable panels to create a frictional relationship between said expandable section and the inner surface of a drain pipe, said expandable section further comprising an internal flange situated above said expandable panels and vertical separators, said vertical separators being supported by said internal flange and providing a minimum vertical distance between said grate and said internal flange whereby fluid passing through said grate may flow between said vertical separators and through said expandable section;

a tapered section formed with a central internally threaded opening to receive a bolt, said bolt extending downward from said central opening such that, when said bolt is tightened said tapered section is drawn upward to cause a sealing engagement to be formed between the walls of a drain pipe and said expandable panels of said floor sink drain screen, and when said bold it loosened, said sealing engagement may be disengaged and collapsed, and said floor sink drain screen may be removed from said drain pipe.

* * * * *